United States Patent [19]

Dorfi et al.

[11] Patent Number: 5,048,843

[45] Date of Patent: Sep. 17, 1991

[54] LACROSSE STICK

[76] Inventors: Kurt H. Dorfi, June Rd., North Salem, N.Y. 10560; Richard C. Mongero, 2164 Crumpond, Yorktown Hgts., N.Y. 10598

[21] Appl. No.: 598,931

[22] Filed: Oct. 17, 1990

[51] Int. Cl.[5] ..... A63B 59/02

[52] U.S. Cl. ..... 273/326; 273/67 R; 273/75

[58] Field of Search ..... 273/326, 67 R, 67 A, 273/67 C, 67 D, 72 R, 75

[56] References Cited

U.S. PATENT DOCUMENTS

| | | | |
|---|---|---|---|
| D. 236,737 | 9/1975 | Brine et al. | D34/5 |
| D. 248,679 | 7/1978 | Rule | D34/5 |
| D. 249,596 | 9/1978 | Rule | D2/27 |
| D. 253,436 | 11/1979 | Lynn | D2/232 |
| D. 256,176 | 8/1980 | Rule | D2/27 |
| D. 257,909 | 1/1981 | Brine | D2/361 |
| D. 263,248 | 3/1982 | Brine, Jr. | D21/210 |
| D. 263,249 | 3/1982 | Rule | D21/210 |
| D. 265,845 | 8/1982 | Brine, Jr. et al. | D21/210 |
| D. 268,853 | 5/1983 | Brine, Jr. | D21/205 |
| D. 269,537 | 6/1983 | Tucker | D21/219 |
| D. 273,601 | 4/1984 | Lewis, Jr. et al. | D21/210 |
| D. 277,691 | 2/1985 | Rule | D21/210 |
| D. 286,666 | 11/1986 | Brine, Jr. | D21/210 |
| D. 286,803 | 11/1986 | Brine, Jr. | D21/210 |
| D. 297,963 | 10/1988 | Tucker et al. | D21/210 |
| 1,459,389 | 6/1923 | Brown | 273/326 |
| 1,917,236 | 7/1933 | Bloomstrand | 273/75 X |
| 2,596,894 | 5/1932 | Frisch | 273/326 |
| 3,507,495 | 4/1970 | Tucker et al. | 273/96 |
| 3,822,062 | 7/1974 | Tucker et al. | 273/96 |
| 3,905,088 | 9/1975 | Tucker et al. | 29/433 |
| 3,910,578 | 10/1975 | Brine, Jr. | 273/96 |
| 3,911,497 | 10/1975 | Lewis, Jr. et al. | 2/16 |
| 4,034,984 | 7/1977 | Crawford et al. | 273/96 |
| 4,037,841 | 7/1977 | Lewis, Jr. | 273/96 |
| 4,062,541 | 12/1977 | Marks | 273/67 R X |
| 4,138,111 | 2/1979 | Rule | 273/96 |
| 4,167,612 | 9/1979 | Tucker et al. | 521/110 |
| 4,206,918 | 6/1980 | Lewis, Jr. | 273/326 |
| 4,272,850 | 6/1981 | Rule | 2/24 |
| 4,318,544 | 3/1982 | Brine, Jr. | 273/65 |
| 4,351,528 | 9/1982 | Duplin | 273/67 |
| 4,385,131 | 5/1983 | Fracalossi et al. | 521/55 |
| 4,422,638 | 12/1983 | Tucker | 273/78 |
| 4,438,220 | 3/1984 | Fracalossi et al. | 521/55 |
| 4,438,221 | 3/1984 | Fracalossi et al. | 521/55 |
| 4,458,034 | 7/1984 | Fracalossi et al. | 521/107 |
| 4,591,469 | 5/1986 | Buchanan et al. | 264/45 |
| 4,618,629 | 10/1986 | Buchanan | 521/76 |
| 4,621,106 | 11/1986 | Fracalossi et al. | 521/130 |
| 4,657,260 | 4/1987 | Brine, Jr. | 273/326 |
| 4,683,246 | 7/1987 | Davis et al. | 521/54 |
| 4,739,994 | 4/1988 | Lewis, Jr. | 273/326 |
| 4,839,393 | 6/1989 | Buchanan et al. | 521/53 |

*Primary Examiner*—William H. Grieb

*Attorney, Agent, or Firm*—Nixon & Vanderhye

[57] ABSTRACT

A lacrosse stick having a head and a handle attached to the head wherein the head comprises a generally V-shaped frame with a crosspiece extending out of the plane of the head. The base of the head includes an arcuate recess along its back side to form with the netting a socket for receiving and retaining the lacrosse ball. The handle is a non-regular octagon in cross-section with the long sides of the handle extending generally parallel to the plane containing the head. The handle is provided at its proximal end with an enlarged butt cap approximately 1.5 times the largest cross-sectional dimension of the handle. The handle also increases in cross-sectional dimension from a median point towards its opposite ends. The netting in the head is replaceable with preformed netting by inserting preformed loops at the ends of the transverse lacing in openings and securing the loops along the outer side frames of the head. The longitudinal reinforcing strips are likewise received in openings and secured in adjusted positions.

26 Claims, 3 Drawing Sheets

LACROSSE STICK

BACKGROUND AND SUMMARY OF THE INVENTION

The present invention relates to lacrosse sticks and more particularly to lacrosse sticks having novel and improved handles and heads for facilitating play.

Lacrosse is a game which has been played for centuries. Up to the modern day, the lacrosse stick almost universally has been formed of wood. Wooden lacrosse sticks, however, lack uniformity from stick to stick and frequently require replacement due to breakage. Present-day lacrosse sticks are considerably improved in these respects because they are constructed of state of the art materials. For example, stick handles are currently formed of aluminum or a combination of graphite and fiberglass. Heads are formed of plastic materials. Notwithstanding these improvements, these modern-day lacrosse sticks have not been altered in configuration or dimension or both in any substantial way to facilitate the play of the lacrosse game. Generally, the modern sticks have followed the older wooden designs, but with modern materials. Consequently, the handle and head of the current lacrosse stick may be more durable and uniform in construction but is essentially of the same design and configuration as the older wooden sticks.

According to the present invention, there are provided discrete novel improvements and enhancements in each of the handle and head of the lacrosse stick whereby lacrosse play can be facilitated and improved. Turning first to the improvements in lacrosse stick handles, it will be appreciated that the conventional lacrosse stick, including those formed of modern-day materials, such as aluminum or fiberglass and graphite, are octagonal in cross-sectional shape. The octagonal cross-section, however, is not regular and has the larger flat opposing sides extending in a transverse direction normal to a plane containing the lacrosse stick head. Stated differently, one of the narrow sides of the octagonally cross-sectional shape of the conventional stick handle lies in the palm of the player's hand when the stick is used during play. As will be appreciated, when carrying the lacrosse ball in its netting, lacrosse players constantly twist or torque the handle of the lacrosse stick to facilitate retention of the ball in the head. The conventional lacrosse stick thus has a cross-section which disadvantageously places the least contact area of the stick, i.e., the narrow side of the octagonal cross-sectional shape of the stick, in the palm of the player. This limits the player's control of the stick, making it more difficult for the player to twist and torque the stick and, likewise, to pass or shoot the lacrosse ball. In accordance with the present invention, the orientation of the octagonal cross-section of the handle is rotated 90° relative to the head such that the larger flat sides of the octagonal cross-section of the handle lie in planes parallel to the plane containing the lacrosse stick head. This maximizes the contact area between the player's palm and the stick during use, improves the player's control of the stick and minimizes or eliminates unwanted twisting, torquing or slippage of the handle in the player's hand.

The present invention also provides an enlarged butt cap on the proximal end of the lacrosse stick. Modern-day lacrosse sticks provide a cap at that end which has very little, if any, lateral extent beyond the cross-section of the octagonally-shaped handle. In the present invention, there is provided a flared butt cap which is substantially enlarged and is at least 1.5 times the largest cross-sectional dimension of the lacrosse stick handle. Preferably, the butt cap is formed of plastic but it could be formed of other materials. By providing an enlarged rounded or octagonal butt cap, a player may more readily hold the stick, particularly during fast swinging motion of the stick, for example, when shooting the ball toward the goal or passing. It will be appreciated, for example, when executing shots on goal, that the player's hand on the stick handle usually slides down to the butt end of the stick handle. The enlarged flared butt cap thus assists the player to generate more centrifugal force when using a whipping action for goal shooting and provides greater stability and control of stick. The greater centrifugal force will allow a player to propel the ball at greater speed because the increased head speed of the cross, i.e., stick, prevents the player from losing the stick.

Further, in accordance with the present invention, the stick handle is flared outwardly from an intermediate portion towards its opposite ends. Preferably, it is flared from a medial location along the stick handle. That is, the cross-sectional dimension of the stick increases from a medial location toward each of its opposite ends. This provides greater area for the player to hold the stick adjacent to its ends and greater frictional contact with and, hence, control over the stick during play. The middle or medial portion of the stick is not usually of significance in terms of swinging the stick while shooting or twisting the stick for retaining the ball in the head. Additionally, the thinner cross-sectional dimension in the middle of the stick provides improved flexibility of the stick, enhancing the whip action obtained by the player when shooting or passing and increasing the velocity of the ball. It will be appreciated that the more flexible the stick handle, the greater the power behind the ball. Further, the overall circumference of the stick handle itself is enlarged in comparison with conventional sticks. For example, the present-day stick has a cross-sectional dimension along its major and minor axes of 1.25 and 1.00 inches, respectively. A stick according to the present invention should, at its thinnest cross-sectional dimension adjacent the median of the stick, have enlarged cross-sectional dimensions, for example, of 1.35 to 1.65 and 1.35 to 1.65 inches along the major and minor axes, respectively.

To further enhance the ability to grasp and retain the grasp on the stick by the player, rubber grips with a textured outer surface are provided adjacent the base and near the head. These grips have an external textured surface, for example, a knurl-like structure, and may be slipped over the handle during manufacture. An adhesive may be used to secure the grips to the handle at the appropriate locations.

With respect to the lacrosse stick head, there is provided in accordance with the present invention a construction adjacent the base of the head which facilitates the retention and security of the ball in the netting and head while still permitting the ball to be passed, shot or knocked from the lacrosse stick head by a defending player. More particularly, a recess is provided at the base of the head frame and along its back side. Preferably, the recess is arcuate in shape and approximates the curvature of the lacrosse ball. Consequently, when the ball is caught in the netting and rolls or slides down the netting toward the base of the head, it is caught and retained in a seat or socket defined between the base of the netting and the arcuate recess of the head frame. Of course, the lacrosse ball sits prominently above the base of the head, e.g., approximately ⅔ of the ball diameter is above the base of the head. Thus, greater security in retaining the ball in the head is obtained while still enabling the ball to be passed, shot or knocked loose from the head during play.

To further enhance the ability of the lacrosse player to catch and retain the lacrosse ball in the head, padding, preferably formed of foam, is secured along the inside face of the head. The padding extends along the oppositely facing or inside sides of the head terminating adjacent the end crosspiece. At the base of the head, the padding is notched or recessed, preferably arcuately, to form a continuation in the notch at the frame of the base of the head. Thus, when the ball moves down toward the recess, the padding inhibits the tendency of the ball to ricochet out of the head. While padding has previously been provided adjacent to the base of the lacrosse stick head, such padding has previously been extremely thin, has not extended up the sides of the head to a position adjacent the crosspiece, and has not been provided with an arcuate notch along its lower end substantially forming a continuation of the arcuate recess in the rigid base of the head frame. The enhanced cushioning effect provided by padding along the sides of the head frame also inhibits the ball from ricocheting out of the head when caught. Additionally, there is provided an outward flare along the front edges of the frame and padding of the lacrosse stick head. Thus, both the padding and the head frame are flared outwardly along opposite sides of the frame to facilitate directing the ball into the netting of the head rather than ricocheting outwardly from the head.

A principal feature of the present invention resides in the provision of a curvature of the top portion of the head out of the plane of the head. Conventional lacrosse stick heads have the side, base and top crosspiece members lying in a single plane. In accordance with the present invention, the generally transversely extending wall or crosspiece at the distal end of the head is disposed forwardly out of the plane of the head. This is afforded by tapering the sides of the frame forwardly out of the plane of the head to connect with the crosspiece. By locating the crosspiece of the head forwardly out of the plane of the head, in contrast to the standard lacrosse stick head which lies wholly in the plane of the head, several advantages are obtained. When the ball is passed, it may be thrown with increased velocity because of this curvature, e.g., similar to the action of a jail alia racket. Greater spin may be applied to the ball. Importantly, this improved shape also forms a scoop so that the ball may be readily scooped from the ground. When running the ability to pick up a rolling ball is greatly enhanced with a curved head.

In accordance with another aspect of the present invention, there is provided an improved netting or lacing for the head of the lacrosse stick which facilitates restringing the head in a very short period of time and without requiring the services of a professional stringer. Lacrosse stick heads are conventionally strung in such a way that breakage of one of the strings of the lacing or the conventional leather thongs requires the head to be wholly restrung. This usually requires return of the lacrosse stick to a professional stringer or shop so that restringing can be accomplished which requires about 1 hour to 1½ hours of labor. In accordance with the present invention, the entire netting may be replaced with ease and efficiency and by the individual lacrosse player in a minimum amount of time, e.g., less than 15 minutes by a non-professional stringer. To accomplish this, the netting is prestrung so that the transverse lacing terminates at its opposite lateral sides in discrete loops. By inserting the loops of the lacing ends in corresponding openings in the side frames, and inserting a further securing lace or thong outside of the side frames and through the loops, the transverse lacing can be secured readily and easily to the lacrosse stick head. Each longitudinally extending lacing is provided with slots and buttons. Thus, the upper ends of these lacings may be inserted through openings in the crosspiece, lapped over the crosspiece and the buttons inserted in the slots. The base or lower ends of the longitudinal lacing may be secured to the base of the head frame similarly or in a conventional manner. Thus, to restring a lacrosse stick head in accordance with the present invention, the side securing laces are removed, i.e., pulled from the loops projecting outwardly of the side frames, to release the transverse looped ends of the transverse lacings for pulling through the frame openings toward the inside of the frame. The ends of the longitudinal lacings are unbuttoned and similarly pulled through the openings in the crosspiece. The opposite ends of the longitudinal lacings may then be untied from the base of the head frame. A new netting may then be secured to the frame by reversing the above-described procedure. That is, the loops of the transverse lacings are inserted through the openings in the frame sides and secured to the frame by inserting the side securing lacings through the loops along the outside of the frame. The ends of the longitudinal lacings are disposed through the openings, reversed over the crosspiece, and buttoned. The opposite ends are then secured to the base of the head. Thus, the services of a professional stringer are not required to tie off the longitudinal lacing at the base.

Alternatively, clips can be provided along the outside surfaces of the head. The clips may take the form of L-shaped members, over which the loops of the transverse or longitudinal lacings, or both, may be received. Instead of the conventional longitudinally extending leather thongs, in accordance with the present invention, a butyl-type rubber is employed for the longitudinal lacing. This has advantages in that it absorbs shock, maintains its resiliency, rather than stretching like leather, and also permits replacement of the net as described previously.

In accordance with a preferred embodiment according to the present invention, there is provided a head for a lacrosse stick comprising a generally V-shaped open frame, with means carried by the frame for securing netting along a back side of the frame and leaving the front side of the frame open for receiving a lacrosse ball. The frame includes a pair of side walls generally lying in a plane and joined one to the other adjacent the lower apex of the generally V-shaped frame by a base including a generally curved surface defined by an axis substantially normal to the plane, the side walls being joined one to the other at the upper end of the frame by a crosspiece. The side walls have a first predetermined width in a direction generally normal to the plane containing the frame and the curved surface has a recess opening therethrough and formed along a back edge of the base of the frame defining at least in part a socket in the frame base for receiving at least part of a lacrosse ball.

In a further preferred embodiment according to the present invention, there is provided a lacrosse stick comprising a head lying generally in a plane and a handle connected at one end to the head. The handle has a cross-section with major and minor axes, the major axis lying generally parallel to the plane containing the head and the minor axis lying generally normal to the plane of the head.

In a further preferred embodiment according to the present invention, there is provided a lacrosse stick comprising a head and a handle connected at one end to the head, the opposite end of the handle carrying a butt cap. The handle has a predetermined cross-sectional configuration and a maximum dimension in one cross-sectional direction, the largest cross-sectional dimension of the butt cap being at least 1.5 times the maximum cross-sectional dimension of the handle.

In a further preferred embodiment according to the present invention, there is provided a lacrosse stick comprising a head and an elongated handle connected to the head at one end thereof, the handle having a minimum cross-sectional dimension at a location intermediate the ends of the handle and increasing in cross-sectional dimension from the intermediate location in both longitudinal directions to provide cross-sectional dimensions adjacent opposite ends of the handle larger than the cross-sectional dimension of the handle at the intermediate location.

In a still further preferred embodiment according to the present invention, there is provided, for use with the head of a lacrosse stick having a frame including spaced side walls, a crosspiece joining the side walls at one end at the top of the frame and a lower frame portion joining the opposite ends of the side walls, the side walls and crosspiece having a plurality of openings disposed therethrough and spaced therealong, a netting for securement to the frame, the netting including transversely extending lacing and longitudinally extending flexible strips. The lacing terminates along opposite sides of the netting in longitudinally spaced, discrete loops for passage through the openings in the side walls of the frame and terminating along the outside surfaces of the side walls. Means are provided cooperable with the loops along the outside of the side walls for releasably retaining the netting to the frame, the longitudinally extending strips having ends receivable through the openings in the crosspiece, and means are provided for releasably securing the ends of the longitudinally extending strips extending through the openings thereof to secure the netting to the frame.

In a still further preferred embodiment according to the present invention, there is provided, for use as part of a lacrosse stick, a lacrosse stick head comprised of a generally V-shaped open frame having a base, side walls and a crosspiece closing the V-shaped frame along its open end, the base having a socket for connection with a lacrosse stick handle, with the base and substantially the entirety of the side walls of the frame lying in a single plane. A plurality of apertures are disposed along the side frames and crosspiece for receiving a netting extending along the back side of the lacrosse stick head, with the crosspiece projecting forwardly from the side frame walls out of the plane of the head to form a scoop-like configuration when viewing the head from one side.

Accordingly, it is a primary object of the present invention to provide a novel and improved lacrosse stick handle, head and netting having various advantages in construction and use in comparison with prior lacrosse sticks and which facilitates the play of the lacrosse game.

These and further objects and advantages of the present invention will become more apparent upon reference to the following specification, appended claims and drawings.

BRIEF DESCRIPTION OF THE DRAWING FIGURES

Figure 1:
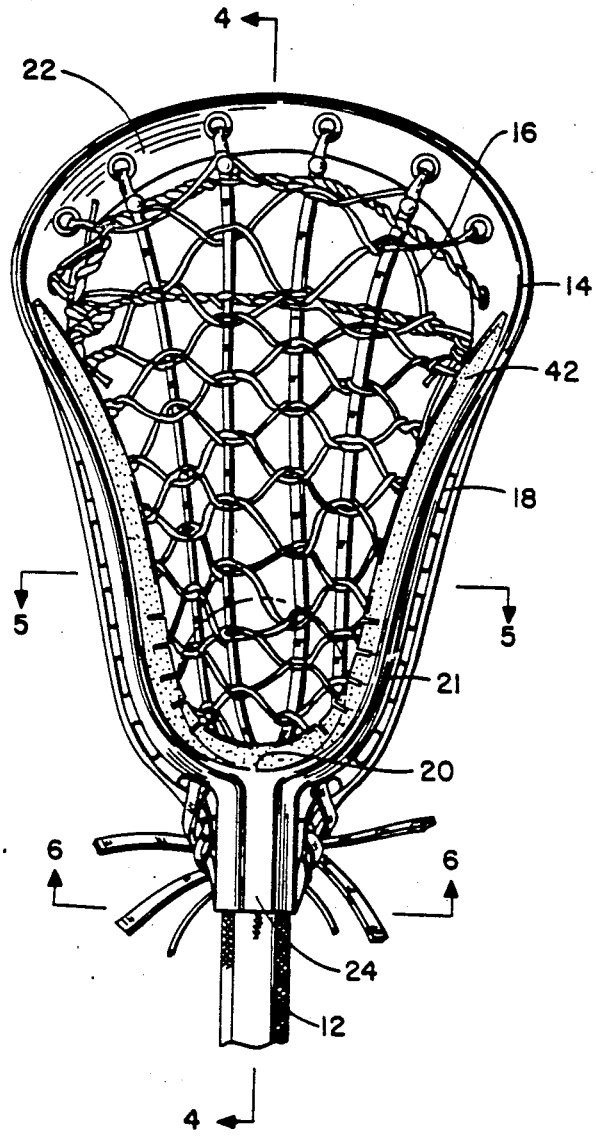
FIG. 1 is a fragmentary front elevational view of a lacrosse stick constructed in accordance with the present invention illustrating the lacrosse stick head and a portion of the handle.
Figure 3:
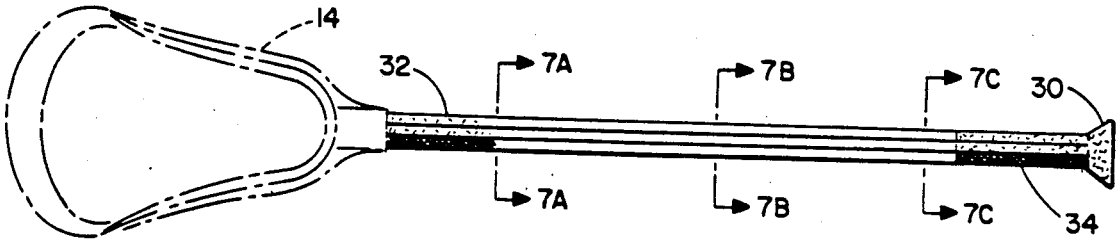
FIG. 3 is a reduced front elevational view of a lacrosse stick illustrating the handle hereof.
Figure 4:
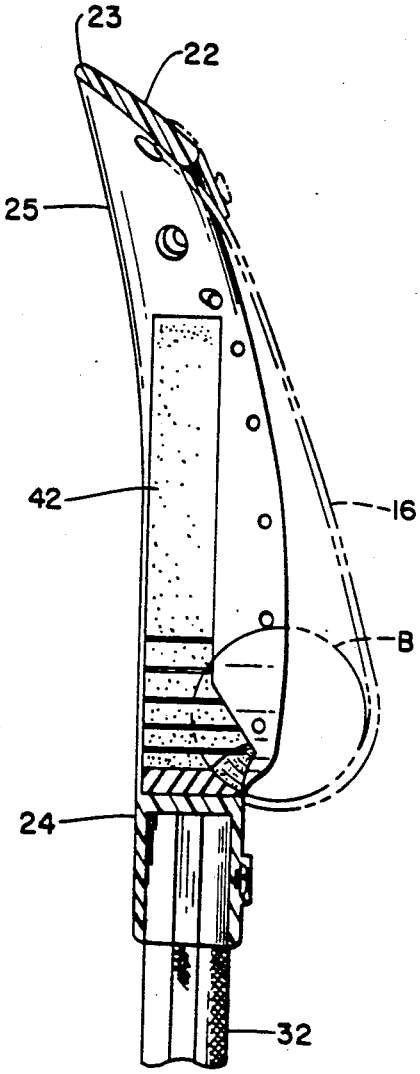
Figure 5:
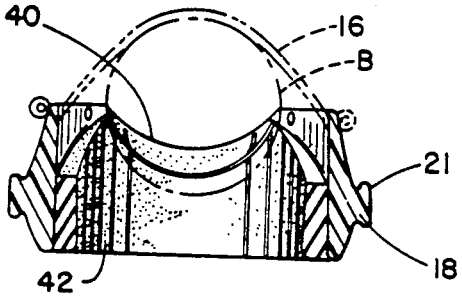
Figure 6:
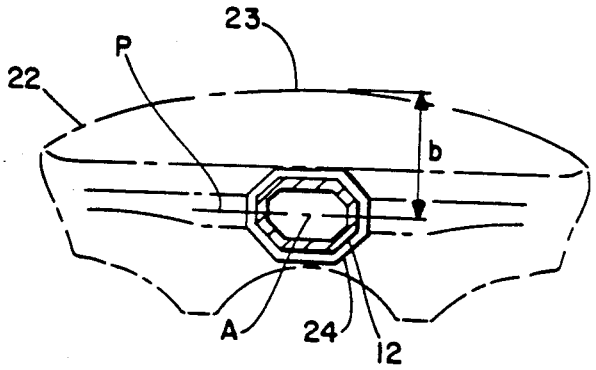
Figure 6A:
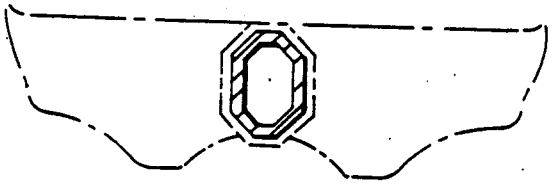
FIG. 6A PRIOR ART
Figure 7A:
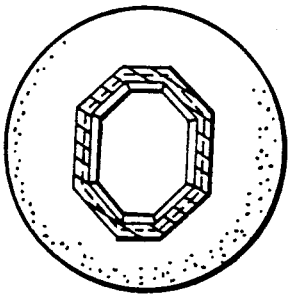
Figure 7B:
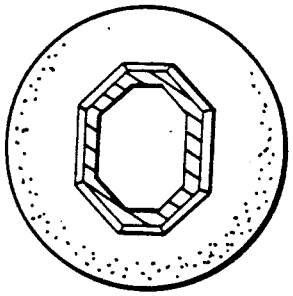
Figure 7C:
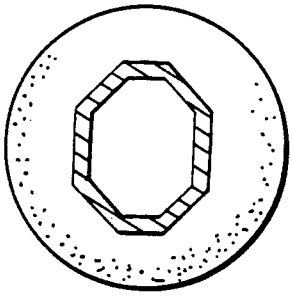
Figure 8:
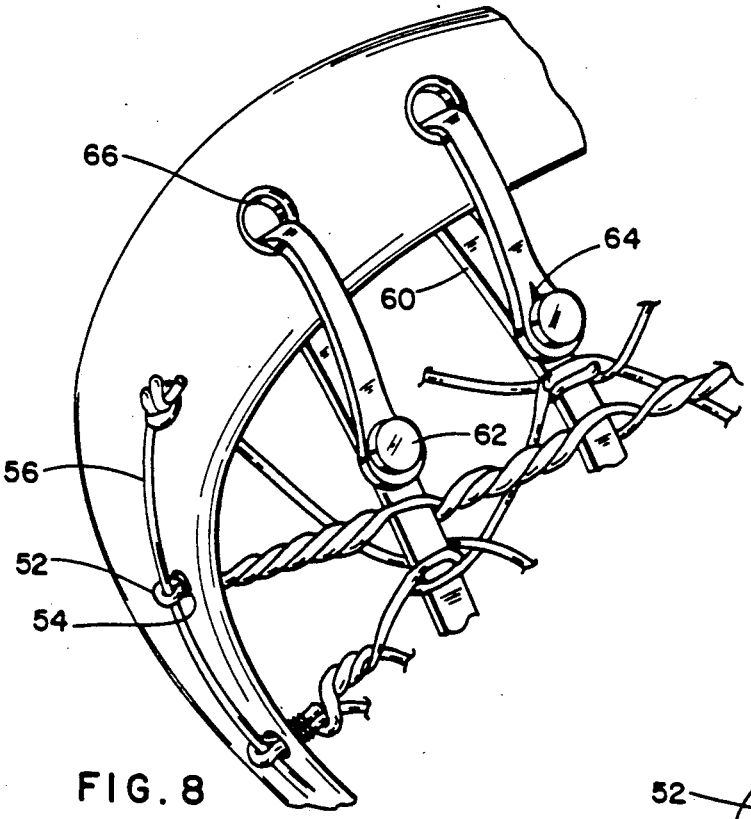
Figure 9B:
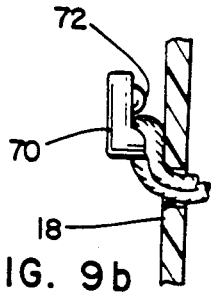
Figure 9A:
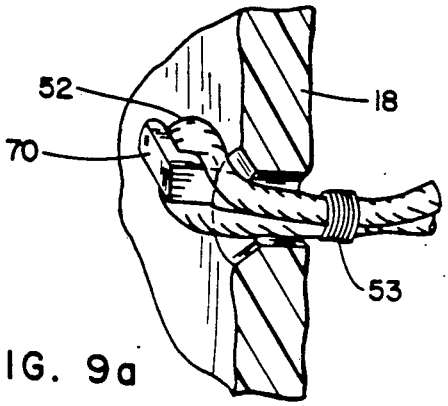

FIGS. 4, 5 and 6 are cross-sectional views thereof taken generally about on lines 4—4, 5—5 and 6—6, respectively, in FIG. 1;

FIG. 6A is a view similar to FIG. 6 illustrating the orientation of the handle vis-a-vis a head according to the prior art;

FIGS. 7A, 7B and 7C are cross-sectional views of the handle taken generally about on lines 7A—7A, 7B—7B and 7C—7C, respectively, in FIG. 3;

FIG. 8 is an enlarged fragmentary view illustrating side and transverse portions of a lacrosse stick head according to the present invention and particularly the manner of connection of the transverse and longitudinal lacings;

FIG. **9*a* is a enlarged fragmentary perspective view with parts in cross-section of a side wall of the lacrosse head illustrating an alternate embodiment of the manner in which the cross-lacing is secured to the head; and FIG. 9*b* is a fragmentary cross-sectional view illustrating the securement for the lacing illustrated in FIG. 9*a***.

DETAILED DESCRIPTION OF THE DRAWING FIGURES

Reference will now be made in detail to a present preferred embodiment of the invention, an example of which is illustrated in the accompanying drawings.

Figure 2:
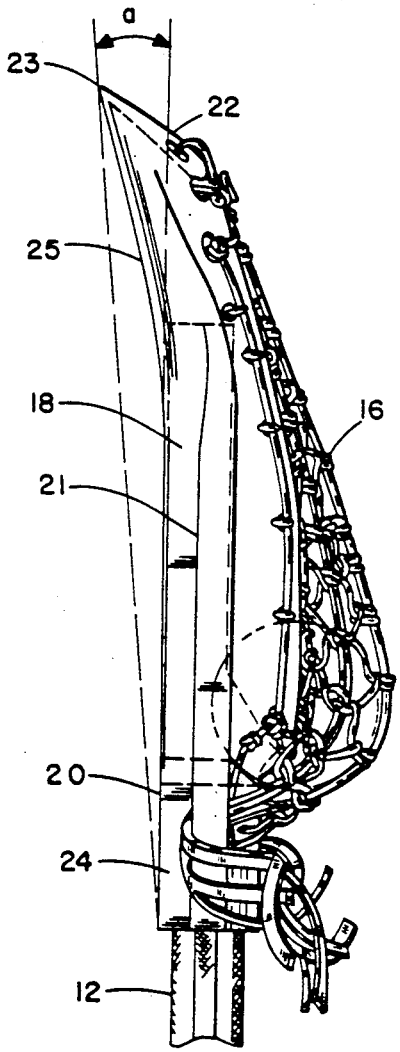
FIG. 2 is a side elevational view of the lacrosse stick of FIG. 1.

Referring now to the drawings, particularly to FIGS. 1 and 2, there is illustrated a lacrosse stick, generally designated 10, comprised of a handle 12, a head 14 and lacing or netting 16 in head 14. The head includes a pair of side walls 18, a base 20, reinforcing 21 along side walls 18, and a transversely extending wall or crosspiece 22 at the upper or distal end of the lacrosse stick 10. The head 14 forms a generally V-shaped frame lying in a single plane, with crosspiece 22 closing the upper end of the frame and lying generally out of the plane as described hereinafter. The base 20 includes a tubular extension or socket 24 for coaxially receiving the distal end of handle 12 whereby handle 12 and head 14 may be connected one to the other.

Turning first to the handle of the lacrosse stick of the present invention, principally illustrated in FIGS. 3, 6 and 7, it will be appreciated that handle 12 has a generally octagonal cross-section with major and minor axes, designated 26 and 28, respectively, in FIG. 6. In FIG. 6, head 14 is illustrated by the dashed lines with the major axis 26 of handle 12 lying parallel to a plane P containing head 14. This is in contrast to the conventional orientation of the handle relative to the head illustrated in FIG. 6A in which the major axis of the octagonally-shaped handle lies perpendicular to the plane containing the head. By forming the handle in this orientation vis-a-vis the head, wider flat side 29 of the octagonally-shaped cross-section of the handle may lie against the palm of the lacrosse player's hand. Thus, the lacrosse player is able to maintain a greater area of contact with the handle during normal use of the stick, and simultaneously minimize or eliminate twisting or torquing of the handle in the player's hand.

As illustrated in FIGS. 7A–7C, handle 12 is also formed of different lateral dimensions at different locations along the length of the handle. Preferably, the medial portion of the handle, for example, as illustrated in FIG. 7B, constitutes the smallest cross-sectional dimension of the handle in both directions of the major and minor axes. Preferably, the handle increases in cross-sectional dimension in the directions of both the major and minor axes in both longitudinal directions from the medial portion of the handle toward its opposite ends. Thus, the handle portion illustrated in FIG. 7A has a greater dimension along the major and minor axes than the corresponding dimensions illustrated in FIG. 7B taken along a median of the handle. Likewise, the dimensions of the handle in the directions of both the major and minor axes adjacent the proximal end of the handle illustrated in FIG. 7C are larger than the corresponding dimensions of the handle at its median. The lacrosse player is thereby provided with a greater area of contact for holding the stick adjacent its upper and lower ends. Hence, the player has greater control of the stick when carrying the ball and is able to provide a substantially greater whipping action and, hence, velocity to the ball because of the thinner cross-sectional dimension of the handle adjacent its median.

Referring also the FIGS. 3 and 7, and in accordance with the present invention, there is provided a butt cap 30 having a very substantial lateral dimension. Preferably, the butt cap 30 is at least 1.5 times the largest cross-sectional dimension of the handle, i.e., 1.5 times the dimension of the handle in the direction of its major octagonal cross-sectional axis. The lacrosse player may therefore slide the handle of the lacrosse stick in his hands until cap 30 butts against his hand, preventing him from losing the stick. This also enhances the player's shooting grip.

As illustrated in FIG. 3, a pair of grips 32 and 34 are provided adjacent the upper and lower ends of the handles, respectively. These grips comprise sleeves, preferably formed of rubber, which have a textured outer surface, e.g., a knurl-like surface, and which grips are preferably glued onto the handle at those locations. This further facilitates the grip of the player on the stick.

Referring now to head 14 as illustrated in FIGS. 1, 2, 4 and 5, there is provided, in accordance with the present invention, a notch or recess 40 formed adjacent the base of the head 14 and along the back side thereof, i.e., the side to which the netting projects. Thus, the base of the head, including portions of the side walls, are notched, preferably arcuately, at 40, corresponding to the curvature of the lacrosse ball indicated by the dashed lines designated B. Thus, the side walls lying in plane P are joined adjacent the lower apex of the generally V-shaped head frame by a base having a generally curved surface defined by an axis substantially normal to plane P. The notch 40 thus is formed along the back edge of the frame, particularly the curved surface thereof, and is curved about an axis non-parallel to plane P with a radius at least as large as the radius of the lacrosse ball. Consequently, when the ball is caught by the netting and moves toward the base of the lacrosse stick where it is carried, it will automatically locate in a seat or notch formed by the lower portion of the netting and the recess 40. The recess 40 thus enhances the ability of the player to retain and secure the ball in the lacrosse stick head while also facilitating play of the ball from the head. To facilitate catching the ball as well as seating it in recess 40, padding 42 is provided along the inside surfaces of the side walls and base portion of the head. Particularly, the padding extends upwardly from the base portion along the inside side walls to terminate just below the beginning of crosspiece 22. At the bottom of the padding adjacent the base, there is provided a notch or recess, preferably arcuate, and which forms a continuation of the arcuate notch or recess 40 at the base of the frame. Thus, when the ball is seated in the lacrosse head, it will also seat against the arcuate notch of the padding as well as the notch in the frame adjacent the bottom of the netting. As best illustrated in FIG. 5, the forward edge of the padding is radiused or rounded in an outward direction. Similarly, the forward edge of the inside of the side walls are flared outwardly. This facilitates catching the ball in the lacrosse stick head in a manner preventing ricochet of the ball from the head. That is, when the ball is caught, the outwardly flared edges of the padding and frame facilitate entry of the ball into the head rather than its ricochet from the head.

A further feature of the present invention resides in a lacrosse stick head wherein the distal end of the head projects forwardly out of the plane of the head. As illustrated in FIGS. 2 and 4, the crosspiece 22 projects forwardly of the open side of the frame. As illustrated, the sides 21 of the frame taper forwardly adjacent their upper ends, with the crosspiece 22 forming a compound curve extending forwardly out of the plane. Consequently, in side elevation, as illustrated in FIGS. 2 and 4, the head takes on the form of a scoop which facilitates passing the lacrosse ball at greater velocity and with greater spin, as well as facilitating scooping of the lacrosse ball from the ground.

In the embodiment illustrated in FIG. 2, the side frames 18 extend from the base 20 of the head linearly a distance approximately one-half the length of the head. As illustrated, the front outer edges 25 of the side frames curve outwardly from that point to the tip 23 of the head. While those outer edges preferably curve in that area, they may extend linearly from about midpoint of the head to the tip. Alternatively, the outer edges of the side frames 18 may be formed along the arc of a curve from base 20 to tip 23. In either case, a plane passing through the linearly extending outer edges of the side frames or passing through a tangent to the arc of such side edges adjacent the base 20 in the event they extend arcuately from base 20 forms an angle "a" with a straight line from base 20 through tip 23. That angle defines the extent to which crosspiece 22 projects forwardly of the open side of the frame and, hence, is a measure of the forward projection or scoop of the head according to the present invention. Preferably that angle "a" is at least 5° and may lie within a range of about 5–35° . Another measure of this is illustrated in FIG. 6 where it will be seen that the tip 23 of crosspiece 22 is spaced from the long axis A through the handle and along the open side of the frame a distance designated "b" at least 1.5 times the thickness of the handle measured in that same direction.

Turning now to FIGS. 1, 2, 8 and 9, there is provided in accordance with the present invention a netting for the lacrosse stick head which can be readily, easily and quickly secured to the head by the lacrosse player and replaced, when a lacing breaks, by a new netting without return of the racket to a professional stringer. This is afforded by a unique connection between the transverse lacing and the longitudinal reinforcing lacing or strips with the sides and crosspiece of the head, respectively. Particularly, the lacing may be formed conventionally, except that the transverse ends of the lacing are formed into loops and tied off. For example, and referring to FIG. 9, the ends of lacing are looped at 52 and tied off at 53. These loops 52 are received in openings 54 spaced along the side walls of the head. A discrete piece of security lacing 56 may then be inserted into the loops at each of their longitudinally spaced positions along the outside of the frame whereby the netting is retained in the head. The discrete securing lacing 56 may be tied off to other lacings or tied to a catch formed on the head itself. For example, lacing 56 may be drawn taut with one end looped about a catch adjacent the bottom of the head, and its opposite end looped and tied off about a finger projecting from the frame. Alternatively, a groove may be formed along the outside surface of the opposite side walls, with the loops of the lacing entering each of the grooves through the openings. The securing lacing 56 may then extend within and along the grooves such that the connection between the netting and the lacrosse head does not project beyond the lateral confines of the side walls of the head.

The longitudinal strips 60 of the netting may similarly be releasably secured to the head. To accomplish this, the strips are provided with one or more buttons 62 and/or one or more slots 64. The ends of the members 60 may be received in openings 66 formed in transverse crosspiece 22 and reverse-folded over crosspiece 22 so that the buttons may be received in the slots 64

It will thus be appreciated that should a lacing or longitudinal member 60 break in the course of use of the stick, the discrete lacings 56 along the sides of the frame may be untied and pulled from the loops 52, thus releasing the transverse lacing from the frame. The longitudinal members 60 of the broken netting may also be unbuttoned and their ends pulled through the opening 66. The base of the netting may then be untied and the broken netting removed from the frame. A wholly new netting may then be inserted in the frame by inserting the loops of the transverse lacing into openings 54. Discrete lacings 56 may then be pulled through those loops along the outside of the frame and tied off. Likewise, the longitudinally extending members 60 may be inserted through openings 66 and secured by buttons 62. The lower end of the netting, principally the longitudinally extending members 60, may be received in openings about the base of the stick and tied off in a conventional manner. Consequently, the netting may be replaced with efficiency, ease and in a timely fashion and without the need for the services of a professional stringer.

Referring now to FIGS. 9*a* and 9*b*, there is illustrated an alternate form of securing the transverse laces to the frame. In this form, the sides of the frame are provided with generally L-shaped projections 70 lying adjacent openings 54. When the loop of the transverse lacing is inserted through the openings 54, it can be received over the top of the L-shaped member 70, thereby securing the lacing to the side wall. The interior surface of the L-shaped member 70 has an inwardly directed projection or bump 72. It will be appreciated that the projections may have other shapes, for example, a button shape.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A head for a lacrosse stick comprising a generally V-shaped open frame;

means carried by said frame for securing a netting along a back side thereof and leaving the front side of said frame open for receiving a lacrosse ball;

said frame including a pair of side walls lying generally in a plane and joined one to the other adjacent the lower apex of said generally V-shaped frame by a base including a generally curved surface defined by an axis substantially normal to said plane, said side walls being joined one to the other at the upper end of said frame by a crosspiece;

said side walls having a first predetermined width in a direction generally normal to the plane containing said frame;

said curved surface having a recess opening therethrough and formed along a back edge of the base of the frame defining at least in part a socket in said frame base for receiving at least part of a lacrosse ball.

2. A head according to claim 1, wherein said recess includes an arcuate edge formed in said base along an axis non-parallel to the first mentioned axis and having a radius at least as large as the radius of the lacrosse ball.

3. A head according to claim 1 including padding of resilient material disposed along opposing inside surfaces of said side walls and along said curved surface portion providing a resilient stop for receiving the ball.

4. A head according to claim 3 including a recess formed along a back edge of said padding forming a continuation of the recess overlying said curved surface portion to define therewith at least part of said socket.

5. A head according to claim 1 wherein the said walls of said head are flared outwardly along the front side of said frame.

6. A head according to claim 1 wherein at least said crosspiece projects forwardly out of said plane.

7. A head in accordance with claim 1 in combination with a lacrosse stick handle, said handle being connected at one end to said head and having a cross-section with major and minor axes, said major axis lying generally parallel to said plane and said minor axis lying generally normal to said plane.

8. A head according to claim 7 wherein said handle forms, in cross-section, a non-regular octagon with the longer sides thereof parallel to said plane.

9. A head according to claim 1 in combination with a handle connected at one end to said head, the opposite end of said handle carrying a butt cap, said handle having a predetermined cross-sectional configuration and a maximum dimension in one cross-sectional direction, the largest cross-sectional dimension of said butt cap being at least 1.5 times the maximum cross-sectional dimension of said handle.

10. A head according to claim 7 wherein the opposite end of said handle carries a butt cap, said handle having a predetermined cross-sectional configuration and a maximum dimension in one cross-sectional direction, the largest cross-sectional dimension of said butt cap being at least 1.5 times the maximum cross-sectional dimension of said handle.

11. A head according to claim 1 in combination with an elongated handle connected to said head at one end thereof, said handle having a minimum cross-sectional dimension at a location intermediate the ends of said handle and increasing in cross-sectional dimension from said intermediate location in both longitudinal directions to provide cross-sectional dimensions adjacent opposite ends of said handle larger than the cross-sectional dimension of said handle at said intermediate location.

12. A head according to claim 11 wherein said handle has a cross-section with major and minor axes, said major axis lying generally parallel to said plane and said minor axis lying generally normal to said plane.

13. A head according to claim 11 wherein the opposite end of said handle carries a butt cap, said handle having a predetermined cross-sectional configuration and a maximum dimension in one cross-sectional direction, the largest cross-sectional dimension of said butt cap being at least 1.5 times the maximum cross-sectional dimension of said handle.

14. A head according to claim 1 wherein said side walls and said crosspiece have a plurality of openings disposed therethrough and spaced therealong, a netting for securement to said frame, said netting including transversely extending lacing and longitudinally extending flexible strips, said lacing terminating along opposite sides of said netting in longitudinally spaced, discrete loops for passage through the openings in the side walls of said frame and terminating along the outside surfaces of said side walls, means cooperable with the loops along the outside of said side walls for releasably retaining said netting to said frame, said longitudinally extending strips having ends receivable through the openings in said crosspiece, and means for releasably securing the ends of said longitudinally extending strips extending through the openings thereof to secure the netting to said frame.

15. A lacrosse stick comprising a head derfining a plane and a handle connected at one end to said head, the opposite end of said handle carrying a butt cap, said handle having a predetermined non-regular octagonal cross-sectional configuration with major and minor axes and a maximum dimension in one cross-sectional direction, the largest cross-sectional dimension of said butt cap being at least 1.5 times the maximum cross-sectional dimension of said handle, said major axis lying generally parallel to said plane and said minor axis lying generally normal to said plane, said butt cap forming, in cross-section, a non-regular octagon with discrete sides in location about said handle corresponding to the sides of said handle.

16. A lacrosse stick comprising a head defining a plane and an elongated handle connected to said head at one end thereof, said handle having a minimum cross-sectional dimension at a location intermediate the ends of said handle and increasing in cross-sectional dimension from said intermediate location in both longitudinal directions to provide cross-sectional dimensions adjacent opposite ends of said handle larger that the cross-sectional dimension of said handle at said intermediate location, said handle having a non-regular octagonal cross-sectional with major and minor axes, said major axis lying generally parallel to the plane of said head and said minor axis lying generally normal to the plane of said head.

17. For use with the head of a lacrosse stick having a frame including spaced side walls, a crosspiece joining said side walls at one end at the top of the frame and a lower frame portion joining the opposite ends of said side walls, said side and transverse walls having a plurality of openings disposed therethrough and spaced therealong, a netting for securement to said frame, said netting including transversely extending lacing and longitudinally extending flexible strips, said lacing terminating along opposite sides of said netting in longitudinally spaced, discrete loops for passage through the openings in the side walls of said frame and terminating along the outside surfaces of said side walls, means cooperable with the loops along the outside of said side walls for releasably retaining said netting to said frame, said longitudinally extending strips having ends receivable through the openings in said crosspiece, and means for releasably securing the ends of said longitudinally extending strips extending through the openings thereof to secure the netting to said frame.

18. For use as part of a lacrosse stick, a lacrosse stick head comprised of a generally V-shaped open frame having a base, side walls and a crosspiece closing the V-shaped frame along its open end;

said base having a socket for connection with a lacrosse stick handle;

said base and substantially the entirety of the side walls of said frame lying in a single plane;

a plurality of apertures disposed along the side frames and crosspiece for receiving a netting extending along the back side of the lacrosse stick head;

said crosspiece projecting forwardly from said side frame walls out of the plane of the head to form a scoop-like configuration when viewing the head from one side.

19. A head for a lacrosse stick according to claim 18 wherein said base includes a generally curved surface defined by an axis substantially normal to said plane, said curved surface having a recess opening therethrough and formed along a back edge of the base of the frame defining at least in part a socket in said frame base for receiving at least part of a lacrosse ball.

20. A head according to claim 19 including padding of resilient material disposed along opposing inside surfaces of said side walls and along said curved surface portion providing a resilient stop for receiving the ball.

21. A head according to claim 20 including a recess formed along a back edge of said padding forming a continuation of the recess overlying said curved surface portion to define therewith at least part of said socket.

22. A head for a lacrosse stick comprising:

a generally V-shaped open frame;

means carried by said frame for securing a netting along a back side thereof and leaving the front side of said frame open for receiving a lacrosse ball;

said frame including a pair of side walls joined to one another adjacent the lower apex of said generally V-shaped frame by a base and adjacent the upper end of said frame by a crosspiece;

said base having an outermost surface along the front side of said frame;

said crosspiece projecting forwardly a distance beyond the outermost surface of said base frame;

said curved surface having a recess opening therethrough and formed along a back edge of the base of the frame defining at least in part a socket in the frame base for receiving at least part of a lacrosse ball.

23. A head according to claim 22 wherein said frame has a shape such that a straight line drawn from said base to the tip of said crosspiece is spaced throughout its length therebetween from all remaining portions of said frame.

24. A head according to claim 23 wherein said base has a socket for coaxially receiving a lacrosse stick handle, said frame having a shape such that a straight line drawn from said base to the tip of said cross piece forms an angle of at least 5° with a straight line passing through the outermost surface of said base and parallel to the axis of said socket.

25. A head for a lacrosse stick comprising:

a generally V-shaped open frame;

means carried by said frame for securing a netting along a back side thereof and leaving the front side of said frame open for receiving a lacrosse ball;

said frame including a pair of side walls lying generally in a plane and joined one to the other adjacent the lower apex of said generally V-shaped frame by a base including a generally curved surface defined by an axis substantially normal to said plane, said side walls being joined one to the other at the upper end of said frame by a crosspiece;

said side walls having a first predetermined width in a direction generally normal to the plane containing said frame; and said side walls and said crosspiece having a plurality of openings disposed therethrough and spaced therealong, a netting for securement to said frame, said netting including transversely extending lacing and longitudinally extending flexible strips, said lacing terminating along opposite sides of said netting in longitudinally spaced, discrete loops for passage through the openings in the side walls of said frame, means cooperable with the loops for releasably retaining said netting to said fame, said longitudinally extending ships having ends receivable through the openings in said crosspiece, and means for releasably securing the ends of said longitudinally extending ships extending through the openings thereof to portions of the corresponding ships lying within the confines of said frame to secure the netting to said frame.

26. A lacrosse stick according to claim 25 wherein one of the ends of each said strip and the portion of the corresponding strip lying within the confines of said frame carries a button, the other of the ends of each said strip and the portion of the corresponding strip lying within the confines of said frame having an opening for receiving said button whereby the engagement of the buttons in corresponding openings releasably secures said netting and said frame to one another.

* * * * *